United States Patent [19]

Forestier et al.

[11] 4,198,929

[45] Apr. 22, 1980

[54] STEAM GENERATOR FOR A PRESSURIZED-WATER POWER STATION

[75] Inventors: Jean Forestier, Montrouge; Bernard Leblanc; Marcel Monteil, both of Paris; Pierre Monteil, Esvres, all of France

[73] Assignee: Commissariat a l'Energie Atomique, Paris, France

[21] Appl. No.: 945,208

[22] Filed: Sep. 22, 1978

[30] Foreign Application Priority Data

Sep. 28, 1977 [FR] France ..... 77 29149

[51] Int. Cl.[2] ..... F22B 1/06

[52] U.S. Cl. ..... 122/32; 165/158; 165/163

[58] Field of Search ..... 122/32, 34; 165/112, 165/158, 163

[56] References Cited

U.S. PATENT DOCUMENTS

| | | | |
|---|---|---|---|
| 3,682,140 | 8/1972 | Roffler | 122/34 |
| 3,841,271 | 10/1974 | Harris, Jr. et al. | 122/32 |
| 3,923,008 | 12/1975 | Beckmann et al. | 122/34 |
| 4,068,627 | 1/1978 | Giesecke et al. | 122/34 |
| 4,088,182 | 5/1978 | Basdekas et al. | 122/32 |

*Primary Examiner*—Kenneth W. Sprague
*Attorney, Agent, or Firm*—Haseltine, Lake & Waters

[57] ABSTRACT

A generator for the production of both superheated steam and saturated steam has an outer casing formed by an inner cylindrical shell engaged within an outer cylindrical shell, the shells being closed by dished ends. An annular header for the admission of pressurized primary water is formed between an upper annular tube plate and a partition-wall while an outlet header for the discharge of primary water is formed by a central tube plate mounted within the inner shell. A bundle of parallel tubes for the circulation of primary water extends vertically upward from the central tube plate. The end portion of each tube has the shape of a crook in order to join the tubes to the annular tube plate in uniformly spaced relation. The secondary water is admitted into the casing by means of ducts formed in the inner shell near the central tube plate. The steam generated is discharged through ducts formed in the outer shell.

4 Claims, 2 Drawing Figures

STEAM GENERATOR FOR A PRESSURIZED-WATER POWER STATION

This invention relates to a steam generator in which a primary fluid consisting of pressurized heavy water or light water passes through a tube bundle and exchanges heat with a secondary fluid also consisting of water in order to convert this latter into saturated or superheated steam. A generator of this type is preferably adapted to operate in conjunction with an installation for the production of electric power by expansion of steam delivered by turbines in which the primary fluid is withdrawn from the cooling circuit of a nuclear reactor. As an advantageous feature, the water which constitutes the secondary fluid is supplied at least partly from a storage tank or station and partly from a circuit which serves to extract the water from the generator itself, the water being extracted at the vaporization temperature and employed especially for resuperheating the steam between the high-pressure and low-pressure sections of the turbines.

Various designs of steam generators of this type are already known, especially those described and claimed in French patent Application No. 77 14888 of May 16, 1977 in the name of Commissariat à l'Energie Atomique in respect of "Forced-circulation steam generator" in which the generator mainly comprises an outer casing and an inner skirt in coaxial relation which are associated with two separate horizontal tube plates consisting of a central plate and an annular plate, and with a U-tube bundle for the circulation of primary fluid. The tubes of the bundle are connected respectively to each of these two plates within the casing and the elbowed portions of the tubes pass beneath the end of the skirt.

The present invention concerns an improvement made in the structure of a steam generator of the type mentioned in the foregoing so as to permit of utilization both as a superheated steam generator and as a saturated steam generator.

To this end, the generator under consideration essentially comprises in combination an outer casing formed by two cylindrical shells having different diameters but a common vertical axis and consisting respectively of an inner shell and an outer shell which are closed at their opposite extremities by end-walls and engaged one inside the other, a horizontal annular tube plate disposed between the upper end of the inner shell and the outer shell, said annular plate being such as to delimit with the cylindrical shells and a parallel partition-wall an annular header for the admission of pressurized primary water, a central tube plate mounted in the inner shell near the bottom end-wall so as to delimit with said end-wall an outlet header for the discharge of primary water, a bundle of tubes which are parallel along the greater part of their length and through which the primary water is circulated. Said tubes extend vertically from the central tube plate and each have a crook-shaped end portion or bend having a downwardly-directed concavity for connecting them to the annular tube plate, said tubes being uniformly connected over the entire annular tube plate. The generator further comprises ducts which serve to admit the secondary water to be vaporized into the casing and are formed in the inner shell in the vicinity of the central tube plate, and outlet ducts which serve to discharge the steam produced and are formed in the outer shell or in the end-wall of this latter.

By virtue especially of the arrangement adopted for the tubes of the bundle and for the tube plates on the one hand with respect to the inlet and outlet headers and on the other hand with respect to the secondary water inlet and outlet ducts, the primary water and the secondary water-steam circulate in countercurrent flow along practically the entire length of the tubes.

The generator advantageously comprises at least one duct for extracting secondary water at the vaporization temperature and superheating the steam produced between the high-pressure and low-pressure sections of the turbines, the extracted water flow being then returned into the generator at a temperature which is even higher than that of the secondary feed-water.

It is also preferably ensured that the inlet ducts for the admission of secondary water into the inner shell of the casing are associated with circumferential distribution elements which are mounted within said shell and serve to distribute the flow within this latter. Finally and in accordance with another particular feature, the tubes of the bundle are suitably spaced by means of grids provided with broached holes through which said tubes are passed.

Further properties of a steam generator constructed in accordance with the invention will become apparent from the following description of two exemplified embodiments which are given by way of indication without any limitations being implied, reference being made to the accompanying drawings, wherein.

Figure 1:
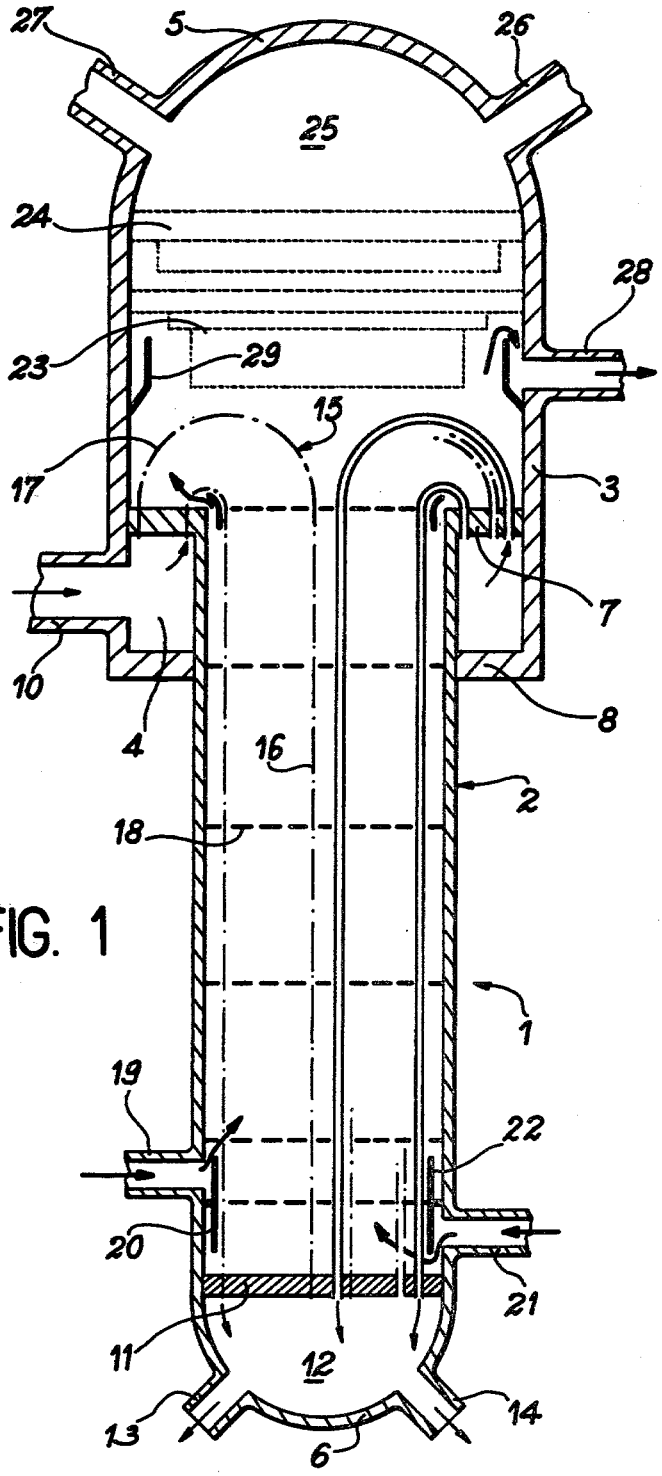
FIG. 1 is a diagrammatic axial sectional view of a steam generator in accordance with a first embodiment of the invention and adapted to the supply of saturated steam.

In the example of construction illustrated in FIG. 1, the reference numeral 1 generally designates the generator in accordance with the invention. The generator is mainly constituted by two cylindrical shells 2 and 3 respectively which have a common vertical axis, the shell 2 being designated hereinafter as the "inner shell" and the shell 3 being designated hereinafter as the "outer shell". These two shells are joined to each other by means of a header 4 having the shape of a toric casing of rectangular section and are closed respectively at their opposite extremities by means of hemispherical end-walls 5 and 6. The top wall of the casing 4 is constituted by a horizontal tube plate 7 of annular shape. The inner and outer walls of said tube plate are joined respectively to the cylindrical shells 2 and 3 so as to form extensions of these latter whilst the bottom wall of the tube plate is a flat annular plate 8. A duct 10 has its opening through the outer wall 3 of said header 4 and serves to admit into this latter the pressurized primary water which is discharged from the nuclear reactor.

Provision is also made at the lower end of the inner shell 2 for a central tube plate 11 which is also horizontal and forms another header 12 or primary water discharge header with the bottom end-wall 6 which closes said cylindrical shell 2. The flow of primary water is thus collected in said header before being discharged from the steam generator through ducts 13 and 14.

In accordance with the invention, the primary water passes through the steam generator via a bundle of tubes 15, only some of which are illustrated in the figure.

Over the greater part of its length, each tube has a vertical leg 16, the lower end of which is joined to the central tube plate 11. At the opposite end and above the open top portion of the cylindrical shell 2, each tube 15 has an extension in the form of an elbowed portion 17 having the shape of a shepherd's crook (downwardly-directed concavity), thus making it possible to join said tubes to the annular plate 7 which delimits the inlet header. By virtue of these arrangements, the pressurized primary water which is introduced into the header 4 through the duct 10 passes through all the tubes 15 and is then collected within the outlet header 12 prior to discharge from the steam generator through the ducts 13 and 14. Preferably, the tubes 15 of the bundle are braced with respect to each other by means of a series of spacer grids 18 shown diagrammatically in the drawing. At the point at which they are traversed by the tubes and especially by the vertical legs 16 of these latter, said spacer grids are provided with broached holes (not shown) for maintaining said tubes in suitable positions without preventing circulation of the secondary water in counterflow to the primary water externally of the tubes.

The production of saturated steam is carried out by admission of secondary water through a lateral duct 19; said secondary water penetrates into the inner shell 2 in the vicinity of its lower end above the central tube plate 11. Said duct 19 is associated within the interior of the shell with a deflector 20 of cylindrical shape for ensuring good distribution of the flow. Provision is also made in the opposite wall of the inner shell 2 for another admission duct 21 which is again associated with a deflector 22. As will be seen hereinafter, the secondary water which is introduced into the shell through said duct 21 corresponds to a return of water extracted from the generator itself in order to ensure resuperheating of the steam between the high-pressure and low-pressure sections of the turbines (not shown) which are associated with the installation. The temperature of the water which is returned into the shell 2 is at a substantially higher temperature than that of the feed water which is introduced through the duct 19 and is consequently intended to ensure efficacious sweeping of the tube plate 11 under the best thermal conditions.

The secondary water within the inner shell 2 undergoes a progressive temperature rise in contact with the tube bundle 15, then vaporizes so as to form a mixture of droplets of water and of steam above the tube bundle 15. The mixture then passes through separators 23 in which it is enriched with steam, then through driers 24 so that the steam collected in the header 25 located beneath the top end-wall 5 of the outer shell 3 is practically dry and finally withdrawn from the generator through the ducts 26 and 27. The duct 28 and cylindrical deflector 29 are advantageously placed beneath the separators 23; as mentioned earlier, this arrangement makes it possible to draw-off part of the secondary water at the vaporization temperature for utilization in an external circuit before being returned to the generator through the duct 21. This arrangement has a further advantage in that it facilitates operation of the separators 23.

The saturated steam generator in accordance with the design just described offers considerable advantages in regard to both performances and operation in comparison with conventional U-tube steam generators. From a performance standpoint, the fact of having a generator which provides systematic flow and good homogenization at a high secondary fluid velocity makes it possible to increase heat transfer to a very substantial extent. In consequence, the pressure within the generator can be increased, thus achieving enhanced efficiency of the installation as a whole, particularly when a superheating system is preferentially employed between the high-pressure and low-pressure sections of the turbines by extraction of secondary water from the generator itself. From an operational standpoint, and apart from excellent stability, the generator is perfectly adapted to follow all load variations by reason of the excellent coupling which exists intrinsically between the steam generator and the nuclear reactor which delivers pressurized primary water. Moreover, the separation of the tube plates and the resulting shape of the tubes permit a considerable reduction of thermal stresses within said plates; in addition, the crook-shaped design of the circulation tubes enables these latter to maintain a sufficient degree of flexibility to meet the problem of differential expansions.

It should further be noted that the arrangements adopted make it possible to prevent the formation of zones of stagnation of secondary water or zones having unfavorable hydrodynamic characteristics.

Figure 2:
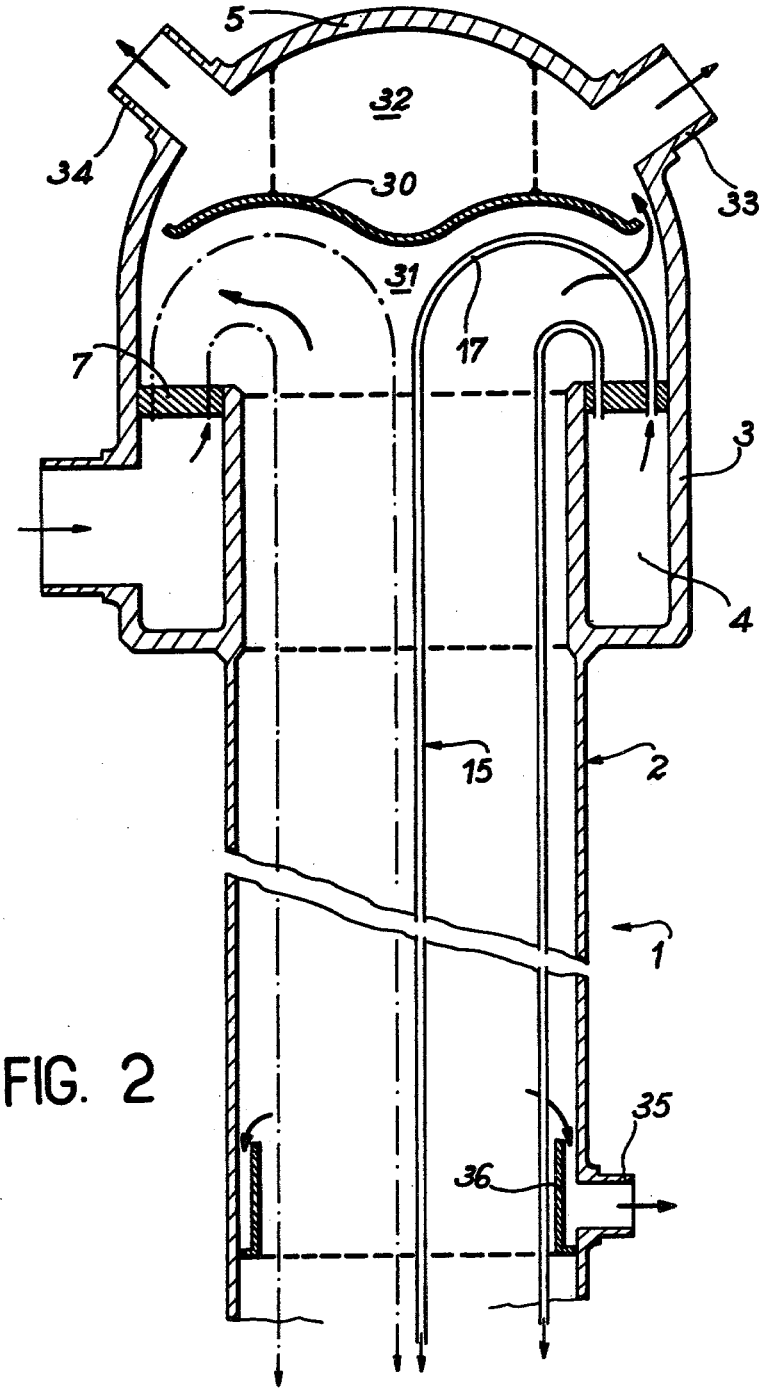
FIG. 2 is a detail view in vertical section to a larger scale showing another alternative embodiment of the generator under consideration for the supply of superheated steam, this view being limited to the upper portion of the generator.

In a second alternative embodiment illustrated in FIG. 2, most of the arrangements adopted in the first alternative embodiment are again shown, although in this case the generator is intended to deliver superheated steam. In particular, there are again shown in this figure the annular tube plate 7 and toric inlet header 4 which provides a connection between the inner shell 2 and the outer shell 3, the bundle of tubes 15 with their vertical legs 16 and their crook-shaped end portions 17 as well as the dished end 5 which closes the top portion of the outer shell.

In this alternative embodiment, however, the region located within the interior of the outer shell 3 above the end of the tube bundle 15 is provided with a transverse deflector 30 so as to ensure that the superheated steam of the region 31 carries out suitable sweeping of the upper portions of the tubes before collecting above said deflector 30 within the header 32 and then being discharged from this latter through the ducts 33 and 34. In this alternative embodiment, withdrawal of water at the vaporization temperature is advantageously carried out through a lateral duct 35 associated with an internal cylindrical deflector 36. Said duct 35 is provided in a zone which corresponds to incipient vaporization of the secondary water in contact with the tubes for the circulation of primary water. As in the previous example, the secondary water which is withdrawn after resuperheating of the steam between the high-pressure and low-pressure sections of the turbines is returned to the bottomm of the generator in order to mix with the feedwater after sweeping of the tube plate 11.

The superheated steam generator in accordance with this design has performances and operating characteristics which achieve a marked improvement over the performances of the straight-tube generators which are usually employed for the production of superheated steam. It should further be mentioned that the generator structure is such that the tubes are uniformly distributed within the inner shell and on the annular tube plate. In consequence, the creation of thermal gradients in a plane at right angles to the axis of the generator is prevented as far as possible. The following summary table gives examples of thermodynamic characteristics of steam generators in accordance with either of the two alternative embodiments described in the foregoing, in which the primary water is derived from a pressurized light water reactor.

| SATURATED STEAM (FIG. 1) | SUPERHEATED STEAM (FIG. 2) |
|---|---|
| Thermal power: 1387 MW | Thermal power: 1387 MW |
| Electrical power: 512 MW | Electrical power: 511 MW |
| Internal diameter: 2.80 m/4.50 m | Internal diameter: 2.80 m/4.50 m |
| Height: 19 m | Height: 20 m |
| Number of tubes: 12,000 | Number of tubes: 12,000 |
| External diameter of tubes: 16 mm | External diameter of tubes: 16 mm |
| Heat-transfer area: 7,500 $m^2$ | Heat-transfer area: 10,200 $m^2$ |
| PRIMARY FLUID | PRIMARY FLUID |
| Inlet temperature: 330° C. | Inlet temperature: 329° C. |
| Outlet temperature: 292° C. | Outlet temperature: 293° C. |
| Flow rate: 5,900 kg/s | Flow rate: 6,238 kg/s |
| SECONDARY FLUID | SECONDARY FLUID |
| a) Feedwater | a) Feedwater |
| Inlet temperature: 243.3° C. | Inlet temperature: 232.5° C. |
| Flow rate: 746 kg/s | Flow rate: 686.6 kg/s |
| Steam | Steam |
| Generator outlet Pressure: 79 b | Generator outlet Pressure: 74 b |
| Temperature: 294° C. | Temperature: 310° C. |
| Flow rate: 746 kg/s | Flow rate: 686.6 kg/s |
| Turbine inlet | Turbine inlet |
| Pressure: 75 b | Pressure: 75 b |
| Temperature: 291° C. | Temperature: 308° C. |
| Flow rate: 746 kg/s | Flow rate: 686.6 kg/s |
| b) Superheating water | b) Superheating water |
| Inlet temperature: 260° C. | Inlet temperature: 250.6° C. |
| Outlet temperature: 295° C. | Outlet temperature: 290° C. |
| Flow rate: 622 kg/s | Flow rate: 536.5 kg/s |
| Total secondary-water flow rate: 1368 kg/s | Total secondary-water flow rate: 1222 kg/s |
| Mean velocity of water in economizer section # 0.82m/s | Mean velocity of water in economizer section # 0.71 m/s |

It is readily apparent that the invention is not limited solely to the examples of construction wich are more especially described both in the foregoing and in the appended claims but extends to all alternative forms.

What we claim is:

1. A steam generator for a pressurized-water power station, wherein said generator comprises in combination an outer casing formed by two cylindrical shells having different diameters but a common vertical axis and consisting respectively of an inner shell and an outer shell which are closed by end-walls at the opposite extremities thereof and engaged one inside the other over a predetermined distance in a direction parallel to the axis aforesaid, a horizontal annular tube plate disposed between the upper end of the inner shell and the outer shell, said annular plate being such as to delimit with the cylindrical shells and a parallel partition-wall an annular header which serves to admit pressurized primary water and the height of which is equal to the distance of engagement, a central tube plate mounted in the inner shell near the bottom end-wall so as to delimit with said end-wall an outlet header for the discharge of primary water, a bundle of tubes which are parallel along the greater part of their length and through which the primary water is circulated, each tube aforesaid being adapted to extend vertically from the central tube plate and to have a crook-shaped end portion having a downwardly-directed concavity for connecting each tube to the annular tube plate, said tubes being uniformly connected over the entire annular tube plate, ducts which serve to admit the secondary water to be vaporized into the casing and which are formed in the inner shell in the vicinity of the central tube plate, and outlet ducts which serve to discharge the steam produced and which are formed in the outer shell or in the end-wall of said shell.

2. A steam generator according to claim 1, wherein said generator comprises at least one duct for extracting secondary water at the vaporization temperature employed for superheating or resuperheating the steam produced between the high-pressure and low-pressure sections of the turbines, the extracted water flow being then returned into the generator at a temperature which is even higher than that of the secondary feedwater.

3. A steam generator according to claim 1, wherein the inlet ducts for the admission of secondary water into the inner shell of the casing are associated with circumferential distribution elements which are mounted within the inner shell and serve to distribute the flow within said shell.

4. A steam generator according to claim 1, wherein the tubes of the bundle are suitably spaced by means of grids provided with broached holes through which said tubes are passed.

* * * * *